US006595380B2

(12) United States Patent
Silvers

(10) Patent No.: US 6,595,380 B2
(45) Date of Patent: Jul. 22, 2003

(54) CONTAINER BASE STRUCTURE RESPONSIVE TO VACUUM RELATED FORCES

(75) Inventor: Kerry W. Silvers, Chelsea, MI (US)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/909,136

(22) Filed: Jul. 19, 2001

(65) Prior Publication Data

US 2002/0074336 A1 Jun. 20, 2002

Related U.S. Application Data

(60) Provisional application No. 60/220,326, filed on Jul. 24, 2000.

(51) Int. Cl.[7] ..... B65D 1/02; B65D 1/42

(52) U.S. Cl. ..... 215/373; 220/606; 220/609

(58) Field of Search ..... 215/373; 220/606, 220/609, 608

(56) References Cited

U.S. PATENT DOCUMENTS 3,468,443 A * 9/1969 Marcus ..... 220/606 X
4,125,632 A * 11/1978 Vosti et al. ..... 220/609 X
4,231,483 A * 11/1980 Dechenne et al. ..... 215/373 X
4,381,061 A * 4/1983 Cerny et al. ..... 220/609 X
4,620,639 A * 11/1986 Yoshino ..... 220/606 X
4,755,404 A * 7/1988 Collette ..... 215/373 X
4,993,567 A * 2/1991 Eberle, Jr. ..... 220/608 X
5,005,716 A * 4/1991 Eberle ..... 220/606 X
5,054,632 A * 10/1991 Alberghini et al. ..... 220/609 X
5,234,126 A * 8/1993 Jonas et al. ..... 220/609
5,472,105 A * 12/1995 Krishnakumar et al. 220/609 X
5,503,283 A * 4/1996 Semersky ..... 215/375
5,971,184 A * 10/1999 Krishnakumar et al. .... 215/384
6,176,382 B1 1/2001 Bazlur Rashid ..... 215/373

* cited by examiner

*Primary Examiner*—Sue A. Weaver
(74) *Attorney, Agent, or Firm*—Harness, Dickey & Pierce, P.L.C.

(57) ABSTRACT

A plastic container having a base portion adapted for vacuum absorption. The base portion including a ring upon which the container is supported, an upstanding wall and a recessed portion. The upstanding wall being adjacent to and generally circumscribing the contact ring. The recessed portion being defined in at least part by a flat base region and a central base region. The flat base region extending from the upstanding wall toward a longitudinal axis of the container. The flat base region defining a projected surface area of at least 45% of a total projected surface area of the container. The flat base region being moveable to accommodate vacuum forces within said container.

27 Claims, 4 Drawing Sheets

CONTAINER BASE STRUCTURE RESPONSIVE TO VACUUM RELATED FORCES

REFERENCE TO PRIOR PROVISIONAL APPLICATION

This application claims the benefit of prior provisional application No. 60/220,326 filed Jul. 24, 2000.

TECHNICAL FIELD OF THE INVENTION

This invention generally relates to plastic containers for retaining a commodity, and in particular a liquid commodity. More specifically, this invention relates to a plastic container base structure that allows for significant absorption of vacuum pressures by the base without unwanted deformation in other portions of the container.

BACKGROUND

Numerous commodities previously supplied in glass containers are now being supplied in plastic, more specifically polyester and even more specifically polyethylene terephthalate (PET) containers. The manufacturers and fillers, as well as consumers, have recognized that PET containers are lightweight, inexpensive, recyclable, and manufacturable in large quantities.

Manufacturers currently supply PET containers for various liquid commodities, such as beverages. Often these liquid products, such as juices and isotonics, are filled into the containers while the liquid product is at an elevated temperature, typically 68° C.–96° C. (155° F.–205° F.) and usually about 85° C. (185° F.). When packaged in this manner, the hot temperature of the liquid commodity is used to sterilize the container at the time of filling. This process and the containers designed to withstand it are respectively known as hot filling, and hot fill or heat set containers.

Hot filling works, and is an acceptable process, with commodities having a high acid content. Non-high acid content commodities, however, must be processed in a different manner. Nonetheless, manufacturers and fillers of non-high acid content commodities desire to supply PET containers for these commodities as well.

For non-high acid commodities, pasteurization and retort are the preferred sterilization methods. Pasteurization and retort both present an enormous challenge for manufactures of PET containers in that heat set containers cannot withstand the temperature and time demands of pasteurization and retort.

Pasteurization and retort are both methods for cooking or sterilizing the contents of a container after it has been filled. Both processes include the heating of the contents of the container to a specified temperature, usually above about 70° C. (about 155° F.), for a specified length of time (20–60 minutes). Retort differs from pasteurization in that higher temperatures are used, as is an application of pressure externally to the container. The pressure is necessary because a hot water bath is often used and the overpressure keeps the water, as well as liquid in the product, in liquid form above its boiling point temperature.

The present invention will find particular utility in hot fill applications, vacuum seal applications and applications where water loss through the container is a concern. It may also find utility in pasteurization and retort applications.

PET is a crystallizable polymer, meaning that it is available in an amorphous form or a semi-crystalline form. The ability of a PET container to maintain its material integrity is related to the percentage of the PET container in crystalline form, also known as the "crystallinity" of the PET container. Crystallinity is characterized as a volume fraction by the equation:

$$\text{Crystallinity} = \frac{\rho - \rho_a}{\rho_c - \rho_a}$$

where $\rho$ is the density of the PET material; $\rho_a$ is the density of pure amorphous PET material (1.333 g/cc); and $\rho_c$ is the density of pure crystalline material (1.455 g/cc).

The crystallinity of a PET container can be increased by mechanical processing and by thermal processing.

Mechanical processing involves orienting the amorphous material to achieve strain hardening. This processing commonly involves stretching a PET container along a longitudinal axis and expanding the PET container along a transverse or radial axis. The combination promotes what is known as biaxial orientation in the container. Manufacturers of PET bottles currently use mechanical processing to produce PET bottles having about 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque (and generally undesirable). Used after mechanical processing, however, thermal processing results in higher crystallinity and excellent clarity. The thermal processing of an oriented PET container, which is known as heat setting, typically includes blow molding a PET preform against a mold heat to a temperature of about 120° C.–130° C. (about 100° F.–105° F.), and holding the blown container for about 3 seconds. Manufacturers of PET juice bottles, which must be hot filled at about 85° C., currently use heat setting to produce PET bottles having a crystallinity range of 25–30%.

After being hot filled, the heat set containers are capped and allowed to reside at generally about the filling temperature for approximately five minutes. The container along with the product is then actively cooled so that the container may be transferred to labeling, packaging and shipping operations. Upon cooling, the volume of the liquid in the container is reduced. This reduction in volume results in the creation of a vacuum within the container. Generally, vacuum pressures within the container range from 1–300 mm/Hg. If not controlled or otherwise accommodated, these vacuum pressures result in deformation of the container which leads to either an aesthetically unacceptable container or one which is unstable. Typically, vacuum pressures have been accommodated by the incorporation of structures in the sidewall of the container. These structures are commonly known as vacuum panels. Vacuum panels are designed to distort inwardly under the vacuum pressures in a controlled manner so as to eliminate undesirable deformation in the sidewall of the container.

While vacuum panels have allowed the containers to withstand the rigors of a hot fill procedure, they do present some limitations and drawbacks. First, during labeling, a wrap-around or sleeve label is applied to the container over the vacuum panels. Often, the appearance of these labels over the sidewall and vacuum panels is such that the label is wrinkled and not smooth. Additionally, when grasping the container, the vacuum panels are felt beneath the label resulting in the label being pushed into the various crevasses and recesses of the vacuum panels.

It would therefore be desirable to have a container which could accommodate the vacuum pressures which result from hot filling yet which has or is capable of having smooth sidewalls.

In view of the above, it is an object of the present invention to provide a plastic container which principally accommodates vacuum pressure through a mechanism other than vacuum panels in the sidewalls of the container.

A further object of the present invention is to provide a container having a base structure which accommodates vacuum pressure while preventing undesirable distortion in other parts of the container.

Still another object of this invention is to provide a plastic container in which the base structure is substantially flat in cross-section in a wall portion thereof which cooperates with an upstanding shoulder wall or ridge to permit the accommodation of vacuum pressures within the base structure.

SUMMARY OF THE INVENTION

Accordingly, this invention provides for a plastic container which maintains aesthetic and mechanical integrity during any subsequent handling after being hot filled and cooled to ambient.

Briefly, the plastic container of the invention includes an upper portion, a body or sidewall portion and a base. The upper portion includes an opening defining the mouth of the container, a threaded portion (or other configuration) as a means to engage a closure, and a support ring that is used during handling, before, during, and after manufacturing. The upper portion further includes a shoulder extending down to the sidewall portion which generally defines the greatest diameter of the container.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

The following description of the preferred embodiment is merely exemplary in nature, and is in no way intended to limit the invention or its application or uses.

As discussed above, to accommodate vacuum forces during cooling of the contents within a heat set container, containers have been provided with a series of vacuum panels around their sidewalls. The vacuum panels deform inwardly under the influence of the vacuum forces and prevent unwanted distortion elsewhere in the container. However, with the vacuum panels, the container sidewall can not be smooth, an overlying label is not smooth, and end users can feel the vacuum panels when grasping and picking up the containers.

Figure 1:
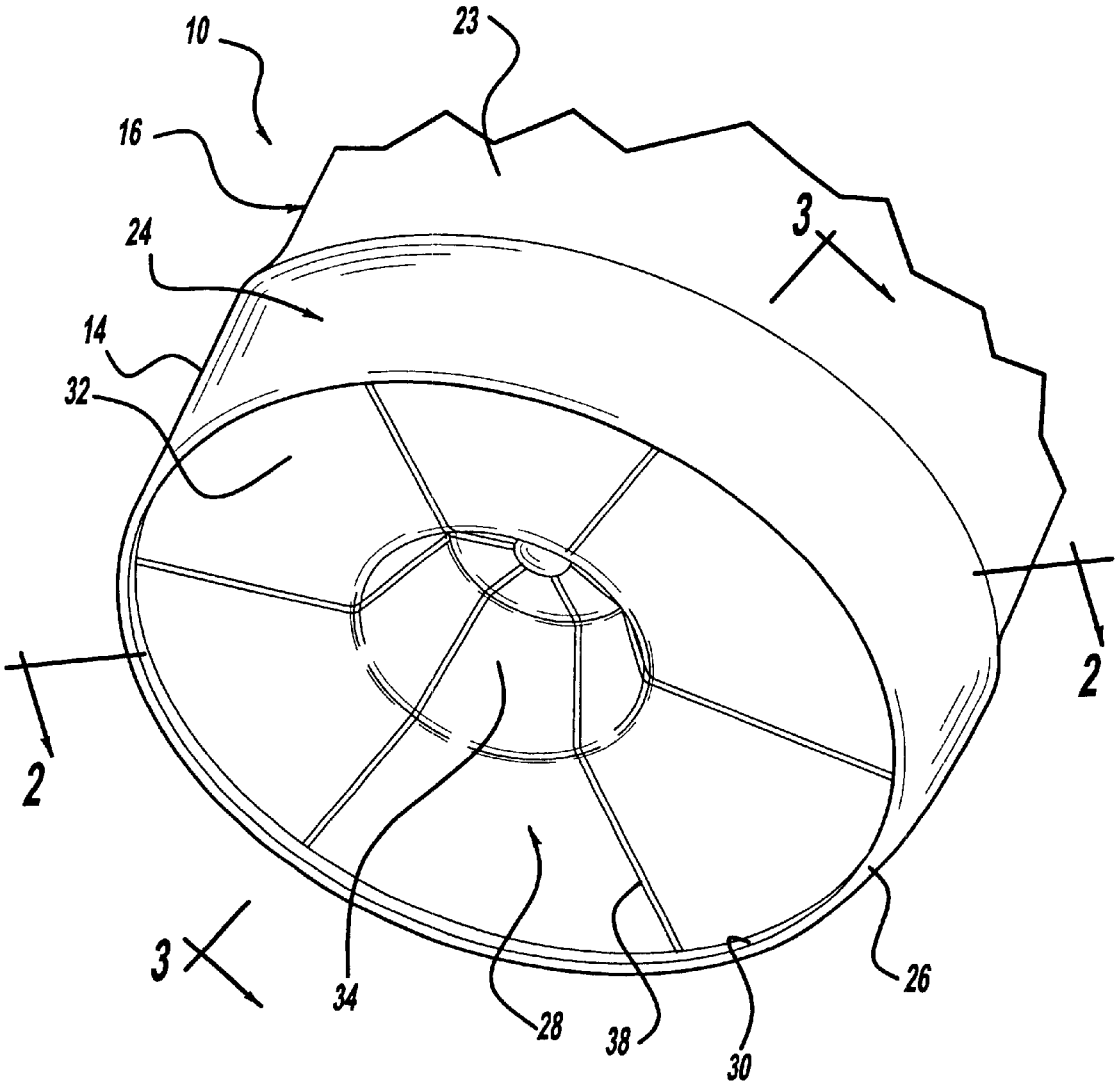
FIG. 1 is a bottom perspective view of a portion of a plastic container according to the present invention.
Figure 4:
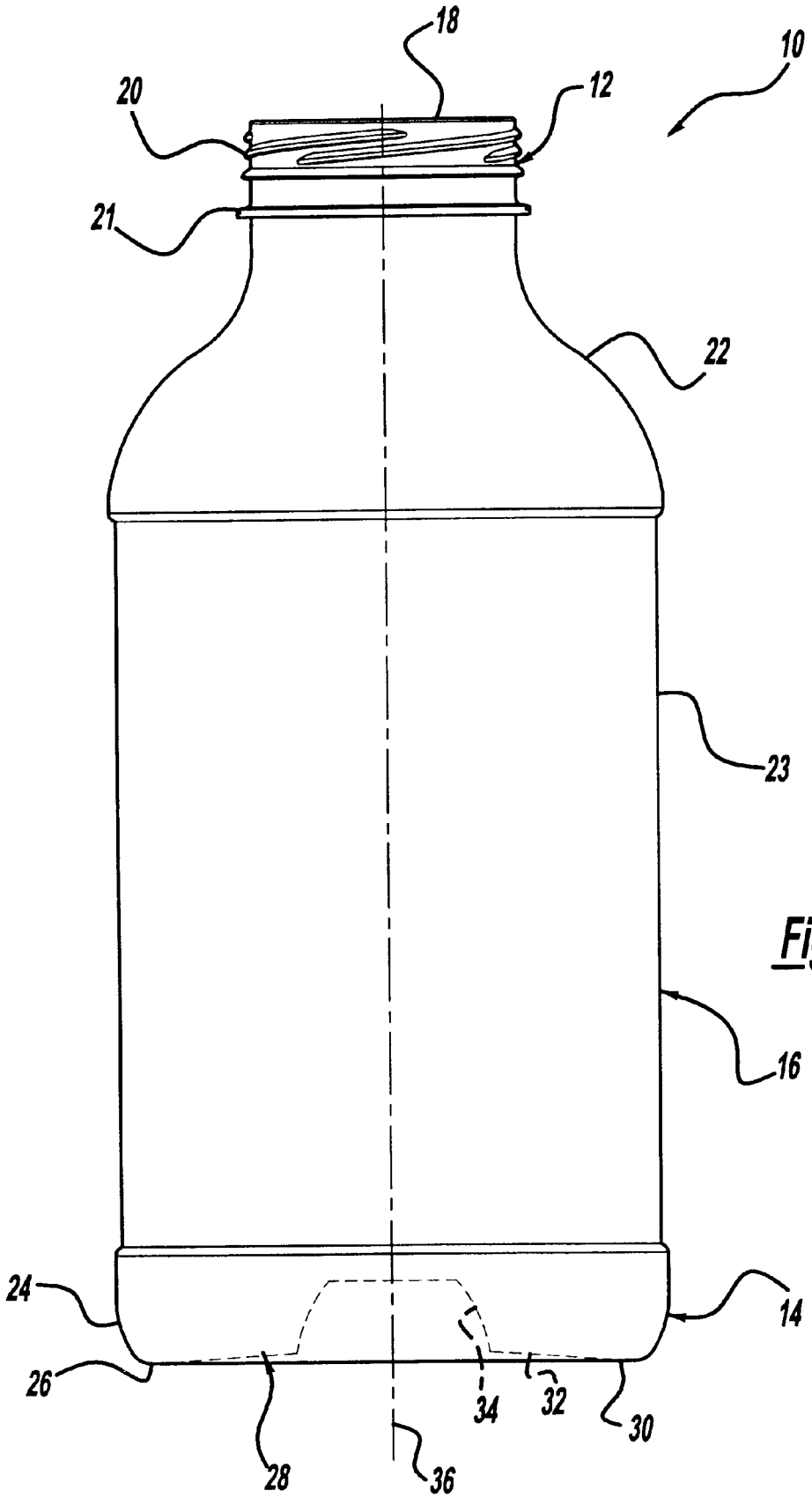
FIG. 4 is an elevational view of the plastic container according to the present invention.

As shown in FIGS. 1 and 4, a plastic container 10 of the invention includes a finish 12, a base portion 14, and a body portion 16. The finish 12 of the plastic container 10 includes portions defining an aperture or mouth 18, a threaded region 20, and a support ring 21. The aperture 18 allows the plastic container 10 to receive a commodity while the threaded region 20 provides a means for attachment of a similarly threaded closure or cap (not shown), which preferably provides a hermetical seal for the plastic container 10. The support ring 21 may be used to carry or orient the preform (the precursor to the container 10) (not shown) through and at various stages of manufacture. For example, the preform may be carried by the support ring 21, the support ring 21 may be used to aid in positioning the preform in the mold, or the support ring 21 may be used by an end consumer to carry the container 10.

The base portion 14 of the plastic container 10, which generally extends inward from the body portion 16, includes a chime 24, a contact ring 26, and an inwardly recessed region 28. The base portion 14 functions to close off the bottom of the container 10 and, together with the finish 12 and the body portion 16, to retain the commodity.

In the preferred embodiment of the invention, the body portion 16, which generally extends downward from the finish 12 to the base portion 14, includes a shoulder region 22 providing a transition between the finish 12 and a sidewall 23. Because of the specific construction of the base 14 of the container 10, the sidewall 23 for the heat set container 10 may be formed without the inclusion therein of vacuum panels, and if desired, smooth.

The plastic container 10 of the present invention is a blow molded, biaxially oriented container with an unitary construction from a single or multi-layer material such as polyethylene terephthalate (PET) resin. Alternatively, the plastic container 10 may be formed by other methods and from other conventional materials. Plastic containers blow-molded with an unitary construction from PET materials are known and used in the art of plastic containers, and their general manufacture in the present invention will be readily understood by a person of ordinary skill in the art.

The plastic container 10 is preferably heat set according to the above mentioned process or other conventional heat set processes.

To accommodate vacuum forces and allow for the omission of vacuum panels in the body 16 of the container 10, the base 14 of the present invention adopts a novel and innovative construction. Generally, the round base 14 is provided with an inwardly recessed region 28 having a generally "flat" area whose projected area is at least 45%, and preferably greater than 55%, of the overall projected area of the base 14. Additionally, an upstanding circumferential wall or ridge 30 forms a transition between the contact ring 26 and the recessed region 28. As used herein, the term "flat" does not, but may, mean precisely flat or without any curative. The term "flat" is primarily being used to differentiate between two or more portions of the recessed region 28.

Figure 2:
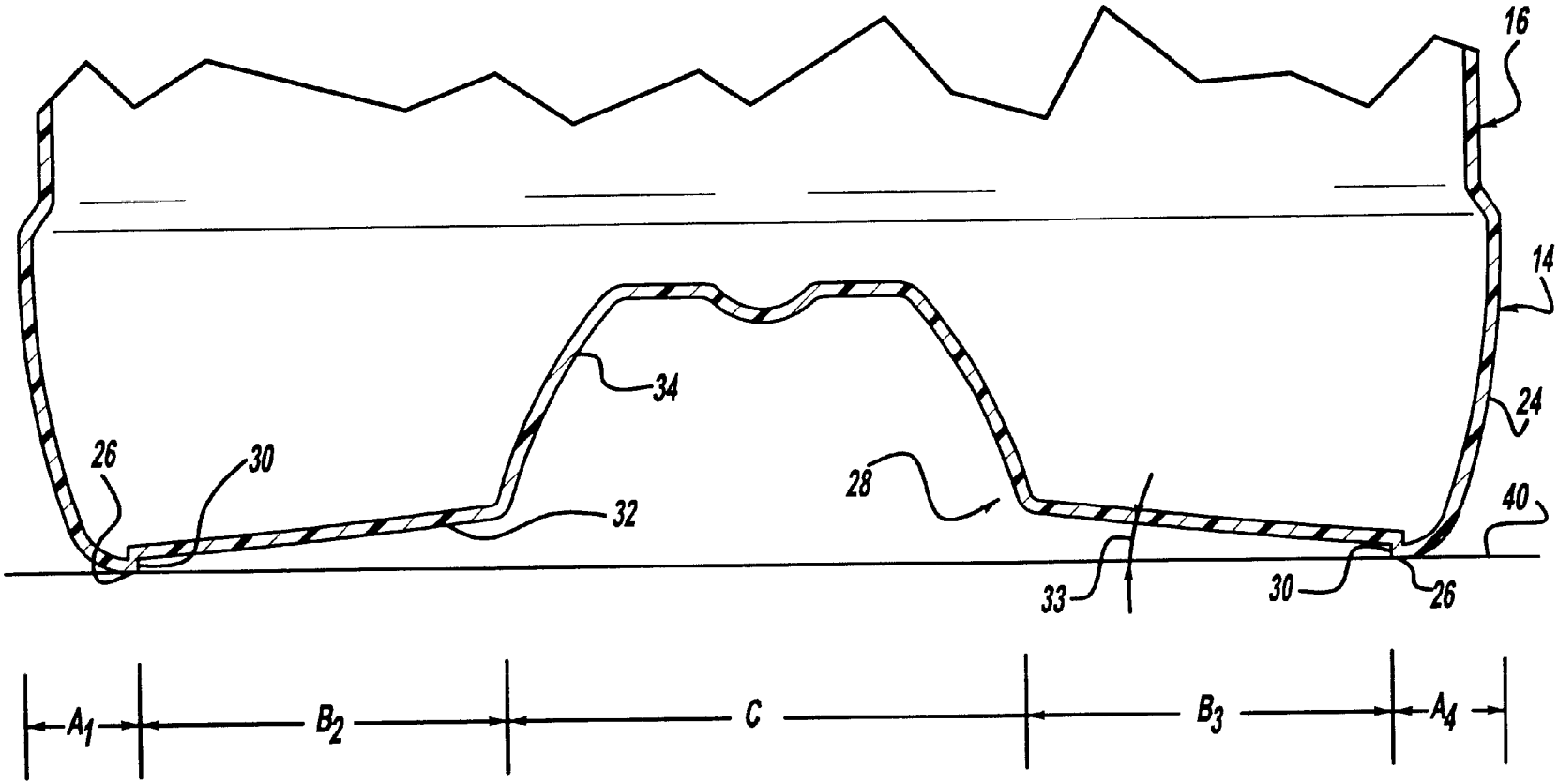
FIG. 2 is a cross-sectional view of the plastic container, taken generally along line 2—2 of FIG. 1.
Figure 3:
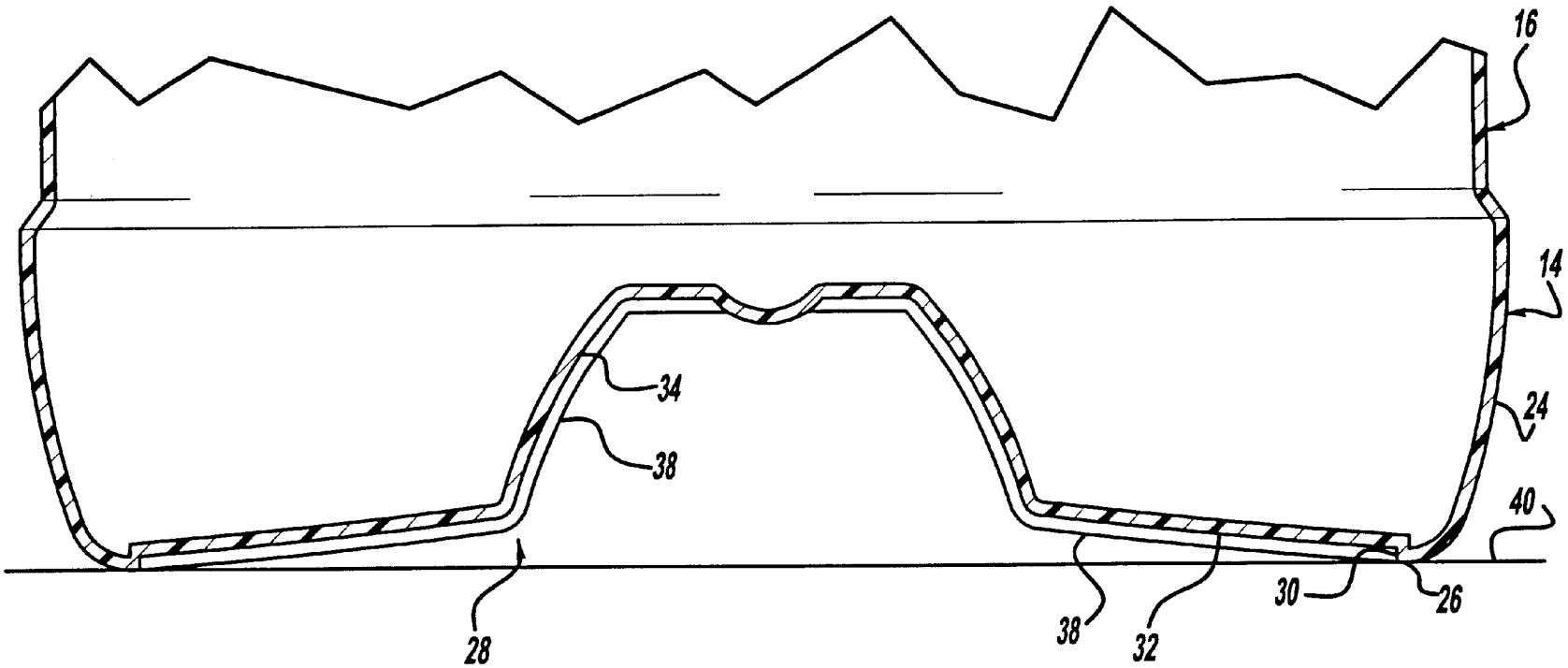
FIG. 3 is a cross-sectional view of the plastic container, taken generally along line 3—3 of FIG. 1.

As shown in FIGS. 2 and 3, the recessed region 28 includes a flat base region 32 and a central base region 34. The flat base region 32 when viewed in cross section is generally planar and slightly up sloping toward a central longitudinal axis 36 of the container 10. The flat base region 32, when viewed three dimensionally, defines a conical surface which lacks an apex because of the central base region 34. In cross section, the flat base region 32 may be provided with a slight curvature (inward or outward, but preferably inward).

The central base region 34 is seen as being a steeply domed area. The exact shape of the central base region 34 can vary greatly depending on various design criteria. For the purposes of the present application, the central base region 34 may be of any shape which deviates significantly from the shape of the flat base region 32.

When initially formed, the flat base region 32 may be substantially parallel to a horizontal plane or a support surface 40. Upon filling, this flat base region 32 will sag or deflect toward the support surface under the temperature and weight of the product. Radial ribs 38, starting in the central base region 34 and terminating at the ridge 30, may be provided in the recessed region 28 to minimize sag and prevent irreversible sagging within the container 10. Upon capping and cooling, the flat base region 32 is raised or pulled upwardly, displacing volume, as a result of the vacuum forces. In this position, the flat base region 32 may exhibit more of the conical shape of FIG. 2. This conical shape may be defined at an angle 33 of about substantially 0° to about 10° relative to the horizontal plane or the support surface 40. The amount or volume which the flat base region 32 displaces is dependent on the projected surface area of the flat base region 32. As used herein, projected surface area means the relative surface area when viewing along the central longitudinal axis 36.

As illustrated in FIG. 2, the relevant projected linear lengths across the base 14 are identified as $A_1$, $B_2$, C, $B_3$ and $A_4$. The projected total surface area ($PSA_T$) of the base 14 is readily defined by the equation:

$$PSA_T=\pi(\tfrac{1}{2}(A_1+B_2+C+B_3+A_4))^2.$$

The projected surface area for the flat base region 32 ($PSA_F$) is defined by the equation:

$$PSA_F=\pi(\tfrac{1}{2}(B_2+C+B_3))^2-PSA_C.$$

The projected surface area of the central base region 34 ($PSA_C$) is defined by the equation:

$$PSA_C=\pi(\tfrac{1}{2}C)^2.$$

In order to eliminate the necessity of providing vacuum panels in the body 16 of the container 10, the flat base region 32 is provided with a projected surface area ($PSA_F$) of at least 45%, and preferably greater than 55%, of the total projected surface area ($PSA_T$). The greater this percentage, the greater the amount of vacuum the container 10 can accommodate without unwanted deformation in other areas of the container 10.

The ridge 30, defining the transition between the contact ring 26 and the recessed region 28, is an upstanding wall (approximately 0.03 inches (0.76 mm) to approximately 0.05 inches (1.27 mm) in height) and is generally seen as being parallel to the center longitudinal axis 36 of the container 10. While the ridge 30 need not be exactly parallel to the central longitudinal axis 36, it should be noted that the ridge 30 is a distinctly identifiable structure between the contact ring 26 and the recessed region 28. The contact ring 26 is itself that portion of the base 14 which contacts the surface 40 upon which the container 10 is supported. As such, the contact ring 26 may be a flat surface or a line of contact generally circumscribing, continuously or intermittently, the base 14.

By providing the ridge 30, the transition between the flat base region 32 and the contact ring 26 is strengthened. This increases resistance to creasing in the base 14. In an alternate embodiment where reduced vacuum forces are encountered, the ridge 30 may be omitted.

While the above description constitutes the preferred embodiment of the present invention, it will be appreciated that the invention is susceptible to modification, variation and change without departing from the proper scope and fair meaning of the accompanying claims.

I claim:

1. A plastic container having a base portion adapted for vacuum absorption, said container comprising:

an upper portion having a mouth defining an opening into said container, a body portion extending from said upper portion to a base, said base closing off an end of said container;

said upper portion, said body portion and said base cooperating to define a receptacle chamber within said container into which product can be filled;

said base including a chime extending from said sidewall portion to a contact ring which defines a surface upon which said container is supported, said base further including a recessed portion defined in at least part by a flat base region extending toward a longitudinal axis of said container, said flat base region being moveable to accommodate vacuum forces generated within said container, said flat base region at least partially circumscribing said axis, said flat base region defining at least 45% of a total projected surface area of said base, and an inwardly domed central base region, said central base region being located centrally within said flat base region.

2. The container of claim 1 wherein said flat base region defines at least 55% of said total projected surface area of said base.

3. The container of claim 1 wherein said flat base region defines a conical portion.

4. The container of claim 3 wherein said conical portion is defined at an angle of less than 10° relative to a horizontal surface.

5. The container of claim 4 wherein said conical portion is defined at an angle of about 10° relative to a horizontal plane.

6. The container of claim 1 wherein said flat base region is generally parallel to a horizontal plane after initial forming and prior to filing.

7. The container of claim 1 wherein said central base region defines a substantial surface deviation from said flat base region.

8. The container of claim 1 wherein said flat base region is generally planar in cross section of half the width of said container.

9. The container of claim 1 further comprising means for coupling said recessed portion to said contact ring and preventing deformation of said contact ring.

10. The container of claim 9 wherein said means for coupling said recessed portion to said contact ring comprising a plurality of radial ribs.

11. The container of claim 1 wherein said body includes a substantially smooth sidewall.

12. A plastic container having a base portion adapted for vacuum absorption, said container comprising:

an upper portion having a mouth, a body extending from said upper portion to a base, said base closing off a bottom of said container, said upper portion, said body and said base cooperating to define a chamber into which product can be filled;

said base including a contact ring upon which said container is supported, said base further including an upstanding wall and a recessed portion, said upstanding wall being adjacent to and generally circumscribing said contact ring, said recessed portion being defined in at least part by a substantially flat base region and a central base region, said central base region being inwardly domed and located centrally within said flat base region, said flat base region extending from said upstanding wall toward a longitudinal axis of said container, said flat base region generally circumscribing said central base region and being generally planar when viewed in a one-half cross-section taken axially through said base, said flat base region defining a projected surface area of at least 45% of a total projected surface area of said container, said flat base region being moveable to accommodate vacuum forces within said container.

13. The container of claim 12 wherein said upstanding wall is generally planar in cross section.

14. The container of claim 12 wherein said upstanding wall is generally coaxial with said axis.

15. The container of claim 12 wherein said upstanding wall is generally parallel with said axis when viewed in axial cross-section.

16. The container of claim 12 wherein said upstanding wall has a height of at least 0.030 inches (0.762 mm).

17. The container of claim 12 wherein said upstanding wall has a height of at least 0.050 inches (1.27 mm).

18. The container of claim 12 wherein said upstanding wall is immediately adjacent to said contact ring.

19. The container of claim 12 wherein said flat base region defines a projected surface area of at least 55% of said total projected surface area.

20. The container of claim 12 wherein said flat base region circumferentially defines a conical surface.

21. The container of claim 20 wherein said flat base region is defined at an angle of less than 10° relative to a horizontal surface.

22. The container of claim 20 wherein said flat base region is defined at an angle of about 10° relative to a horizontal surface.

23. The container of claim 12 wherein said flat base region is defined at an angle parallel to a support surface for said container.

24. The container of claim 12 wherein said upstanding wall transitions to said flat base region at a substantially sharp corner.

25. A plastic container having a base portion adapted for vacuum absorption, said container comprising:

an upper portion having a mouth defining an opening into said container, a body portion extending from said upper portion to a base, said base closing off an end of said container;

said upper portion, said body portion and said base cooperating to define a receptacle chamber within said container into which product can be filled;

said base including a chime extending from said sidewall portion to a contact ring which defines a surface upon which said container is supported, said base further including a recessed portion defined in at least part by a flat base region extending toward a longitudinal axis of said container, said flat base region being movable to accommodate vacuum forces generated within said container, said flat base region at least partially circumscribing said axis, said flat base region defining at least 45% of a total projected surface area of said base, and a central base region being located centrally within said flat base region and defining a substantial surface deviation from said flat base region.

26. The container of claim 25 wherein said central base region is inwardly domed.

27. A plastic container having a base portion adapted for vacuum absorption, said container comprising:

an upper portion having a mouth defining an opening into said container, a body portion extending from said upper portion to a base, said base closing off an end of said container;

said upper portion, said body portion and said base cooperating to define a receptacle chamber within said container into which product can be filled;

said base including a chime extending from said sidewall portion to a contact ring which defines a surface upon which said container is supported, said base further including a recessed portion defined in at least part by a flat base region extending toward a longitudinal axis of said container, said flat base region being movable to accommodate vacuum forces generated within said container, said flat base at least partially circumscribing said axis, said flat base region defining at least 45% of a total projected surface area of said base; and means for coupling said recessed portion to said contact ring and preventing deformation of said contact ring, wherein said means for coupling comprises a plurality of radial ribs.

* * * * *